United States Patent [19]

Turzillo

[11] 3,962,879

[45] June 15, 1976

[54] REINFORCED PILE IN EARTH SITUS AND METHOD OF PRODUCING SAME

[76] Inventor: Lee A. Turzillo, 2078 Glengary Road, Akron, Ohio 44313

[22] Filed: Sept. 16, 1974

[21] Appl. No.: 506,171

Related U.S. Application Data

[63] Continuation-in-part of Ser. No. 356,760, May 3, 1973, abandoned.

[52] U.S. Cl. ..... 61/53.52; 61/53.62

[51] Int. Cl.[2] ..... E02D 5/24

[58] Field of Search ..... 61/53.62, 53.6, 53.5, 61/56.5, 56, 63, 53.52

[56] References Cited

UNITED STATES PATENTS

| | | | |
|---|---|---|---|
| 3,091,090 | 5/1963 | Müller | 61/53.62 X |
| 3,608,317 | 9/1971 | Landau | 61/63 X |

*Primary Examiner*—Jacob Shapiro

*Attorney, Agent, or Firm*—Donnelly, Maky, Renner & Otto

[57] ABSTRACT

A concrete pile or like concrete column formed in earth situs by rotating a continuous flight auger consisting of one or more sections into the earth to form a cavity of given depth; rotating the auger to remove augered earth from the cavity without removing the auger therefrom, and replacing the removed earth from the auger flights with fluid cement mortar, which hardens to form a column reinforced by the auger resultantly anchored in the same. A plurality of short auger sections may be connected together in succession during drilling to form a cavity of requisite depth by increments when low headroom conditions exist. A portion of the auger or a shaft portion without auger flighting thereon may also protrude above the earth situs for extension through water and the like and be filled with cementitious material which is allowed to harden. The method may also include first filling the auger shaft with the fluid mortar and allowing the same to harden in the shaft with a passage extending therethrough, and supplying more mortar through the passage to fill the cavity to form the column against backing of hardened mortar in the shaft.

27 Claims, 9 Drawing Figures

REINFORCED PILE IN EARTH SITUS AND METHOD OF PRODUCING SAME

CROSS-REFERENCE TO RELATED APPLICATIONS

This application is a continuation-in-part of applicant's prior co-pending U.S. Serial No. 356,760, filed May 3, 1973, now abandoned.

BACKGROUND OF THE INVENTION

Heretofore, augered concrete piles have been installed in the earth of a situs under low headroom conditions, by drilling down with a short length of auger to form a cavity of corresponding depth, unscrewing the auger drive means from the short auger, and then progressively adding additional short lengths of auger to increase the depth of the cavity by corresponding increments until requisite full depth was reached. This process was then reversed by withdrawing the auger by like incremental steps, each time pumping fluid cement mortar into the vacated cavity extent, and each time removing a top auger section until all sections were removed, and the entire cavity extent was filled with cement mortar to become a hardened bearing pile. In other words, the cavity was filled with cement mortar in a series of spurts thereof, somewhat difficult to control accurately, and requiring disconnection of the auger driving mechanism for removal of each auger section, all with a very substantial loss of installation time, labor and materials. Moreover, delayed continuance of the mortar pumping steps tended to cause cold or imperfect joinder of the next adjacent concrete pile extents, and this condition could be further aggravated by entry of foreign materials.

SUMMARY OF THE INVENTION

The method of the present invention has for its primary object the forming a concrete pile or like column in an earth situs under low headroom conditions, in substantially less time than accomplished heretofore, and thereby correspondingly reduce the labor and material costs. The improved method includes drilling a first one of a plurality of readily attachable short sections of flighted hollow shafted auger, on a power-operated drilling rig, to drill a cavity of correspondingly short depth in the earth situs. Additional said short auger sections are progressively affixed between a protruding upper end of the auger and the power drive, correspondingly to extend the length of the auger for progressively repeating said drilling operation, and thereby to extend the cavity depth by short increments, until the required depth of cavity is attained. The fully extended auger is then rotated in screwing direction within the full depth cavity to convey the augered earth from the cavity while retaining the extended auger, with its hollow shaft, within the same, and self-hardenable, fluid cementitious material is pumped through the hollow shaft of the auger or by other means, to fill the drilled cavity. This operation is aided by rotation of the auger in a screwing direction to convey the fluid cement along the auger flighting and fill the cavity while retaining the auger in the cavity. The fluid cementitious material is thereafter allowed to harden as a solid pile body, reinforced by said hollow-shafted auger embedded in the same.

This cavity filling step can be varied to advantage, as by first filling the auger shaft with fluid mortar around a central pipe in the auger shaft and after allowing the mortar to harden, pumping pressurized fluid mortar through the pipe to fill the drilled cavity, while rotating the auger as before with resultant advantages related to attainment of piles having improved skin friction.

Retention of the segmented auger within the cavity eliminates the costly waste of time, labor and materials which otherwise would be required by the prior method to remove the auger from the drilled cavity at ground level, one section at a time, and reattaching the upper end of the auger to the drilling rig each time the auger sections are successively removed, for pumping more fluid mortar into new voids in the cavity created by partial withdrawal of the auger.

While the present invention has primary application in situations where low headroom conditions exist, necessitating the use of one or more short sections of continuous flight auger to drill a hole of predetermined depth, substantially the same procedure may be followed for installation of augered tie backs as well as vertical or batter piles utilizing a single section of continuous flight auger of the desired length or a plurality of sections which have been preassembled to provide a continuous flight auger of the desired full length prior to drilling. A portion of the auger or a shaft portion without auger flighting thereon may also protrude above the earth situs for extension through water and the like and be filled with cementitious material which is also allowed to harden as a columnar body within the hollow shaft.

Generally speaking, the type of power-operated, auger drilling rig which could be utilized, with some modification, for practicing the improved pile-forming method, are to be found in Turzillo U.S. Pat. Nos. 3,464,216 and 3,604,214. It is to be understood, however, that the one use, sectional drilling auger of the present method, can be of less costly, light-weight materials and construction, as compared with the durable, more costly, continuous flight augers generally in use for producing concrete piles in situ.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENTS

Figure 1:
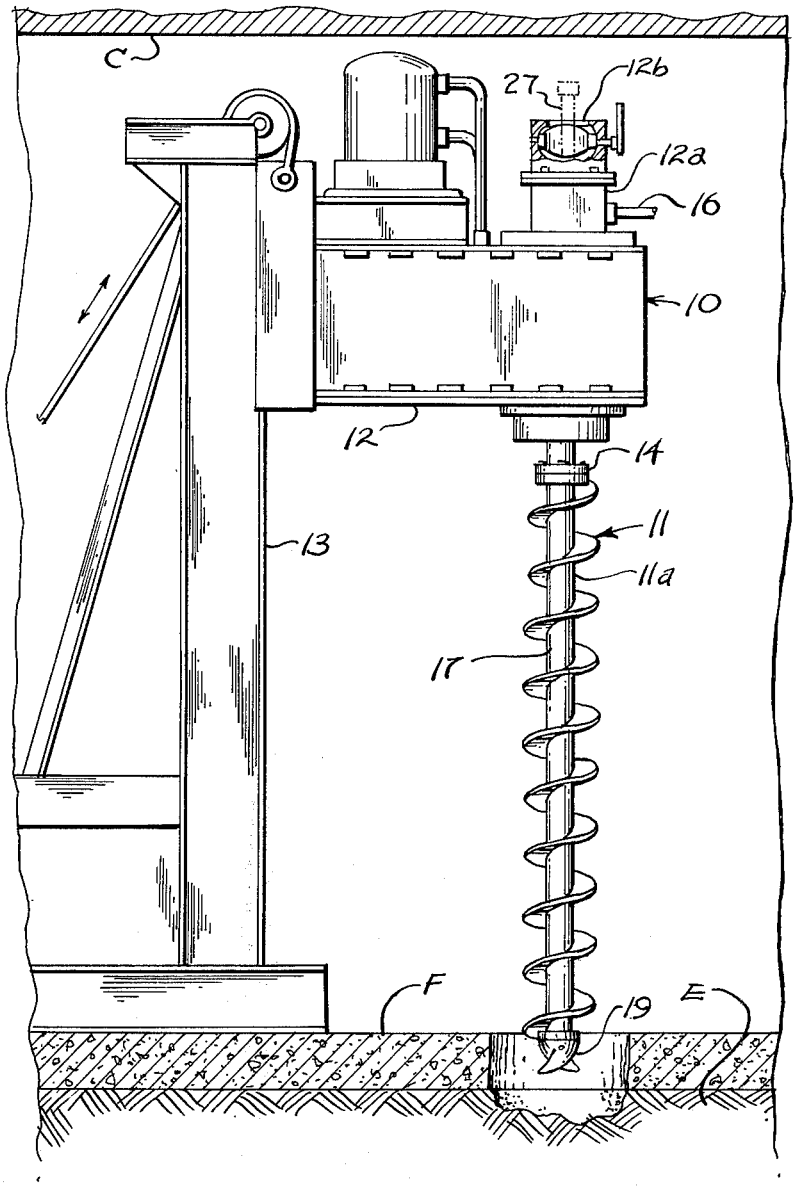
FIG. 1 is a side elevation of a pile-forming drilling rig positioned for an initial step of the method, within a low headroom area over an earth situs with one short section of a multiple section, continuous flight, auger preassembled on the rig within limited available headroom, ready for operation of the drilling rig to start forming a first incremental cavity extent in the situs.

Referring first to FIG. 1 of the drawings, there is illustrated an auger drilling rig 10, for practicing the method of the invention, installed in a low headroom area over a earth situs E, such as between a concrete floor F and a ceiling C in a building. The rig 10 for this purpose may include one short section 11*a*, of a continuous flight, hollow-shafted auger 11, rotatably mounted on a power carriage 12 which is in turn vertically movably mounted on a relatively fixed, low headroom upright 13, in known manner. FIG. 1 shows the rig 10 provided with a first of a plurality of selectively attachable, relatively short, auger segments 11*a*. That is, a plurality of such short, hollow shafted, auger segments 11*a* are adapted to be quickly attached one to another in the low headroom area by use of threaded or other known coupling means, for drilling a cavity of full predetermined depth in the situs by short incremental stages corresponding to the lengths of the auger sections 11*a*.

Figure 2:
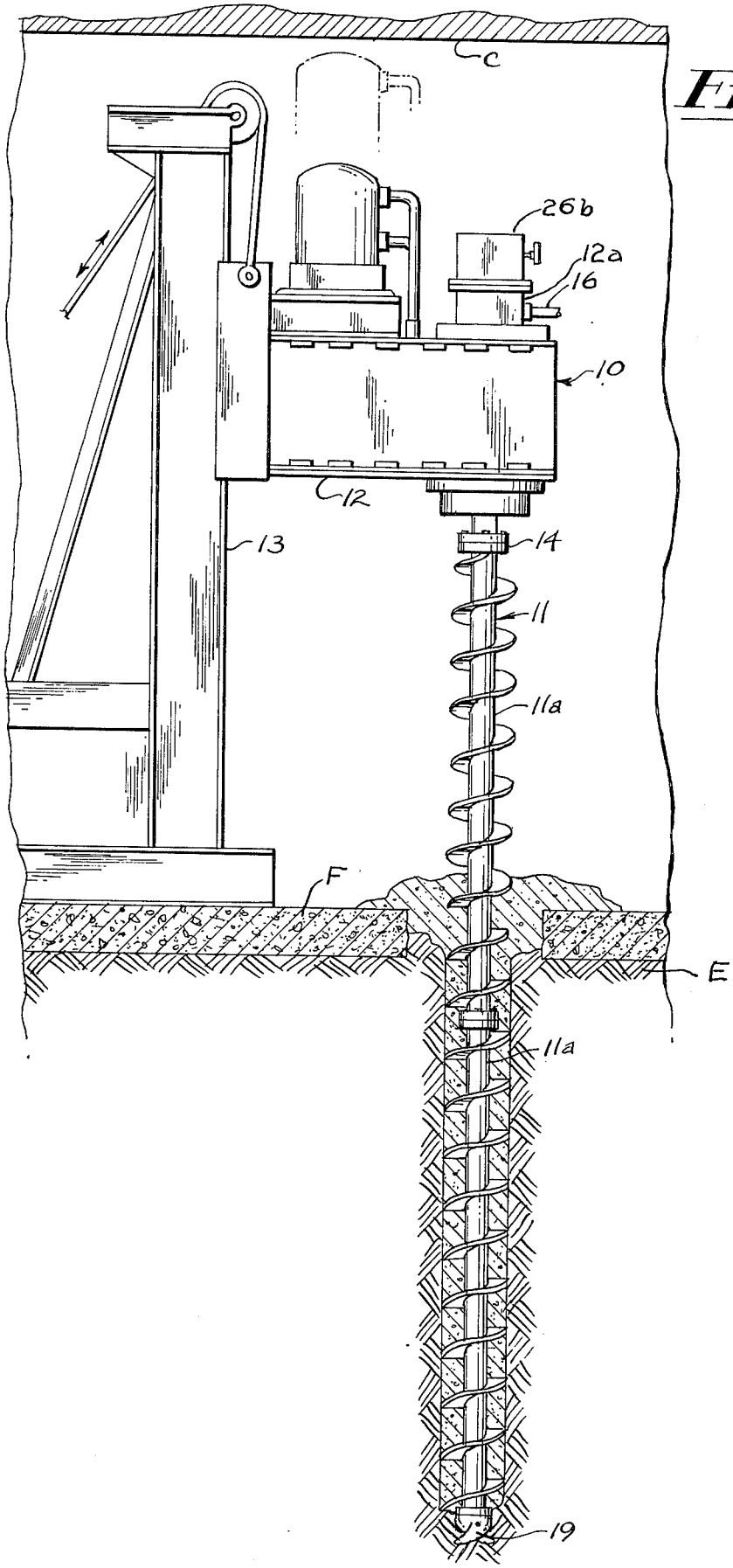
FIG. 2 is a view corresponding to FIG. 1, illustrating a subsequent step in the method, and wherein a second short auger section has been attached or coupled between the drilling rig and the first auger section, after formation of the first incremental cavity extent and after the rig has been operated for the start of a second incremental drilling operation.

In practice of the method of the invention to provide a load-bearing concrete column in the earth situs E, the drilling rig 10 is positioned as shown in FIG. 1, with carriage 12 elevated for attachment of a first short auger segment 11*a* of the auger 11 to a power operable stub shaft 14 on the carriage 12. With the first short section 11*a* rotating in a screwing direction, the carriage 12 is forcibly urged downward or caused to advance on its own due to the pitch of the auger flighting and the weight of the auger itself to penetrate the auger into the earth E, thereby to form a first, correspondingly short incremental cavity extent E-1 in the earth E (see FIG. 2). There may be occasions when one short section of auger will provide a cavity of the requisite depth. However, where a greater depth is required, the following procedure is desirably employed.

Figure 3:
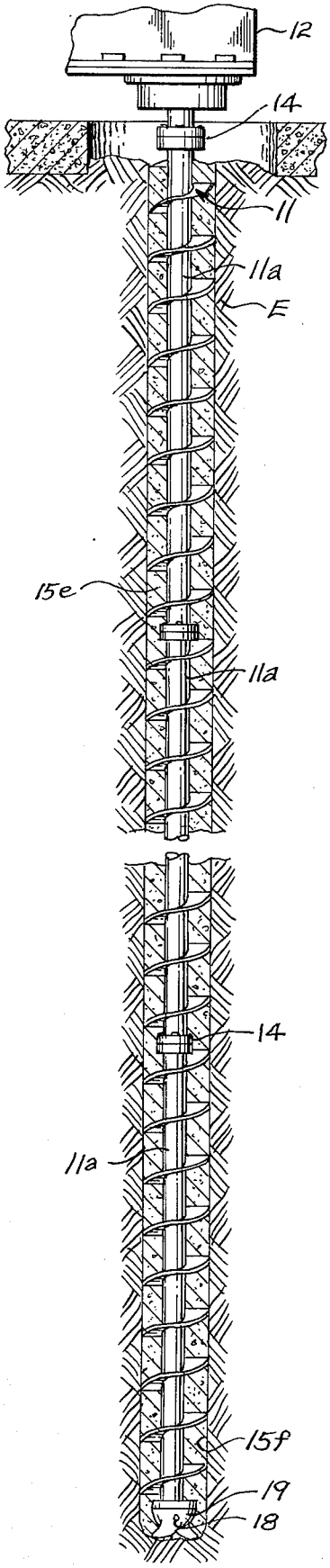
FIG. 3 is a view corresponding to FIG. 2, in which a cavity of full, predetermined depth has been formed by progressive addition of short auger segments, and corresponding further projection of the auger into the earth of the situs.

Without necessarily removing the augered earth from the first short cavity extent E-1 the carriage 12, after uncoupling the first auger section 11*a* therefrom, may be elevated back to the up position shown in FIG. 1, after which a second short auger section 11*a* is connected between the coupling 14 and the first auger section. The extended auger 11 is rotated, as before, simultaneously with downward urging of carriage 12 (See FIG. 2), to increase the depth of the cavity to a second proportionate incremental extent. This operational step of drilling with added auger segments 11*a* is repeated as often as necessary, until a cavity 15*f* of predetermined full depth is defined, as shown in FIG. 3.

Figure 4:
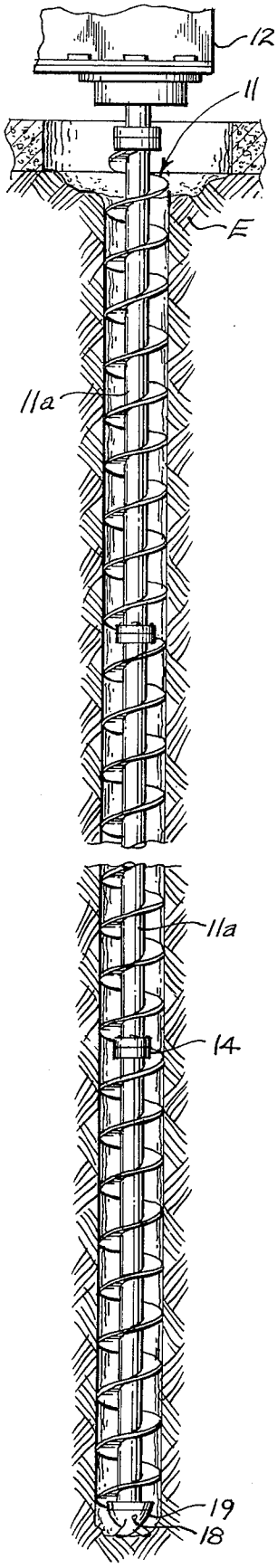
FIG. 4 is a view corresponding to FIG. 3, wherein the segmental auger of requisite full length has been rotated in screwing direction, to remove the augered earth from the fully drilled cavity without withdrawing the auger from the cavity, and thereby providing a spiral void between the auger shaft and the augered cavity.

Upon drilling the defined cavity 15*f* to full depth, as described, the full length, segmented auger is retained in the cavity while being again rotated in screwing direction, to convey the augered earth 15*e* upwardly along the auger flighting to be disposed of above ground level in suitable manner. FIG. 4 illustrates the resultantly formed hollow cavity 15*f*, with the full length auger 11 retained therein. Alternatively, the earth may be retained on the auger flighting until replaced by cement mortar in a manner to be subsequently described.

Figure 5:
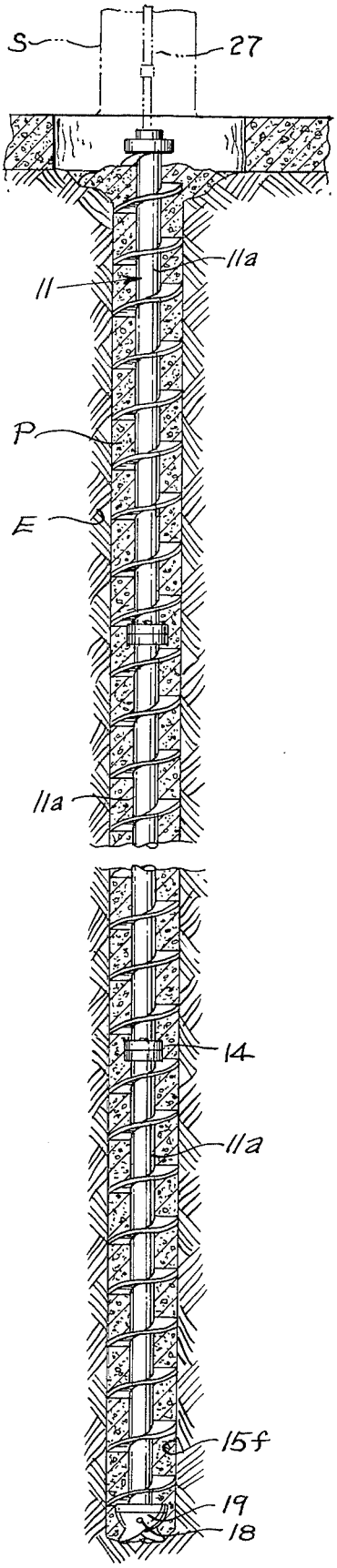
FIG. 5 is a view corresponding to FIG. 4, wherein the extended auger has been rotated in screwing direction by the drilling rig without retraction of the auger from the cavity, while fluid, self-hardenable cement mortar has been pumped through the auger shaft to convey the mortar up the auger flighting until the cavity is filled with mortar, as well as the space within the auger shaft.
Figure 6:
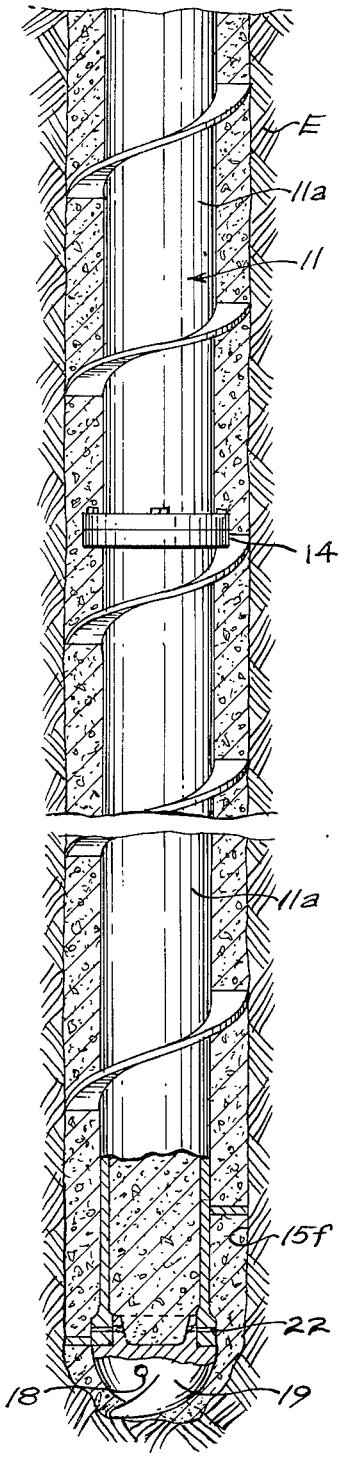
FIG. 6 is an enlarged fragmentary cross-section corresponding to the lower portion of FIG. 5, to illustrate the disposition of the hardened concrete within the pile cavity, and also within the auger shaft, to form a solid concrete pile reinforced by the auger per se.
Figure 7:
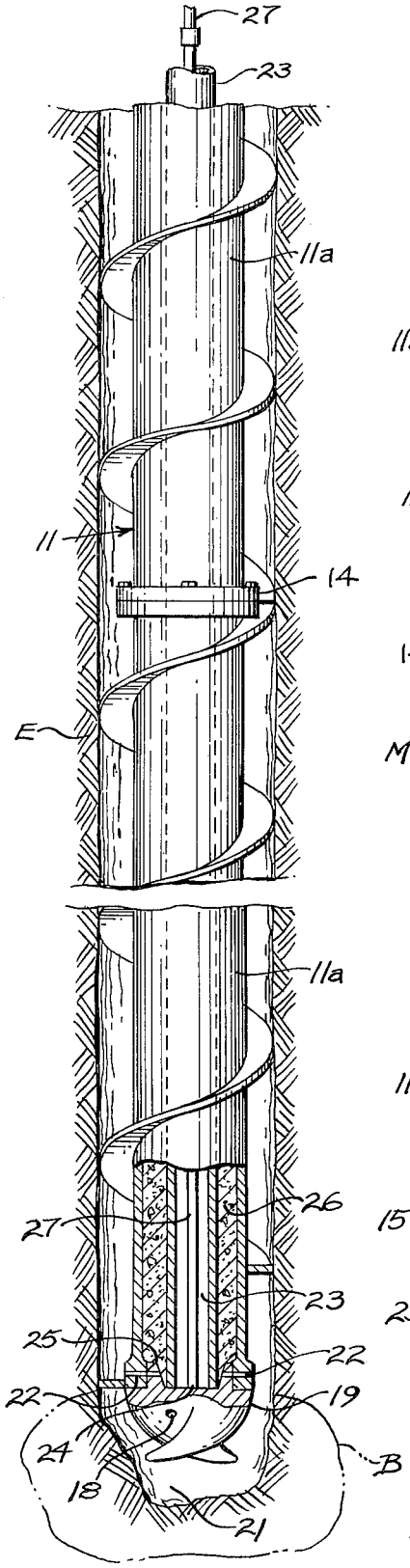
FIG. 7 is a view like FIG. 6, but illustrating a modified procedural step of the method at a stage corresponding the stage shown in FIG. 4 in which the earth has been removed from the cavity, the modification including a step inserting a pipe centrally within the auger shaft to be sealed at its lower end against a forcibly removable drill bit on the lower end of the auger shaft, and then having self-hardenable mortar fed into the shaft to fill the annular space between the shaft and the pipe.

Next, by means of suitable conduit means 16, connected between a fixed housing 12*a* on the carriage 12 and a source of supply of fluid, self-hardenable, hydraulic, cement mortar, not shown, such fluid mortar is supplied under pressure, through hollow shaft 17 of the auger, and through aperture means 18 in a bit or like closure 19 at the lower end of the first, or lowermost auger section 11*a*, while at the same time the extended auger is rotated in a screwing direction, which will remove any earth remaining on the auger flights and convey the fluid mortar upwardly along the auger flighting, thereby to fill the cavity 15*f* with fluid mortar and form a columnar concrete body with the entire auger embedded therein, as shown in FIGS. 5 and 6. As will be apparent, a cork or other suitable plug may be inserted in the aperture 18 to prevent it from becoming plugged with dirt during the drilling operation and subsequently removed as by grout pressure, as well known in the art. Also, if desired, the closure 19 may be releasably affixed to the bottom of the auger shaft as by suitable break-away pins, wedges, ball detents, or other suitable means to permit release of the closure after the drilling operation for discharge of fluid mortar from the body of the auger shaft, in which event the aperture 19 may be eliminated.

Where necessary or desirable, water may be initially pumped into the cavity 15*f*, to enlarge the cavity and/or form an enlargement at the bottom thereof, as shown in chain-dotted lines in FIG. 7, and into which the fluid mortar would be pumped as described above to form a concrete bulb B. Pumping of fluid mortar then may be continued, as described above, until the hollow shaft 17 of the auger is also filled with mortar as illustrated in FIG. 6. After this last-mentioned step the auger 11 may be disconnected, at the upper end thereof, from the stub shaft 14 on the carriage 12, to permit removal of the drilling rig 10 from the drilling area.

Upon ultimate hardening of the resultant reinforced concrete pile P, in the earth E of the situs, the same may be utilized for supporting an overhead structure (not shown) as by means of a concrete or other column positioned on top of the auger-reinforced pile, as shown in chain-dotted lines at S in FIG. 5.

The above described new method permits employment of relatively inexpensive, one use augers, as for example having an 8 inch O.D. hollow shaft and a flighting pitch on the order of 12 inches, and with a flighting width or depth on the order of 2 to 4 inches.

The improved method also makes it possible to produce in an earth situs, a solid concrete pile P which is uniformly and strongly reinforced by having the one use auger solidly anchored therein. The method described has particular utility, in that the formed concrete pile or column, being thus steel reinforced, will have strong resistance to shear and bending forces. Moreover the method accomplishes its purpose with a minimum of soil disturbance and vibration, as compared with methods requiring step by step removal of auger sections under low headroom conditions. Other advantages of the method include avoidance of contamination of the concrete pile body with foreign materials, and provision of higher skin friction between the finished concrete pile body and the drilled cavity wall, with attainment of the resultant pile body having improved load bearing capacity. In addition, the method can be effectively practiced where it is necessary to drill through soft earth materials or in a situs containing a soft overburden.

A modification of the method of the invention may include preliminary steps of the method substantially as described above to the stage shown in FIG. 4, along with other procedure to be described in connection with FIGS. 7 and 8. That is, the auger 11 is used to form a hollow cavity 15*f* of requisite depth, as before. The cavity 15*f*, however, is drilled in a manner to provide a hollow space 21 below the lower end of the auger shaft, as by backing the auger off slightly after reaching the requisite depth or by pumping water into the cavity to form an enlargement at the bottom thereof to permit subsequent ready removal of the bit 19 held non-rotatably affixed in the end of the auger shaft as by suitable break-away pins 22, wedges, ball detents, wire, or similar means. A square shank may also be provided on the bit 19 for receipt in a square opening in the bottom of the auger shaft to cause the bit 19 to be positively driven by the auger shaft during rotation thereof. While retaining the bit 19 affixed in the shaft, a segmented pipe or conduit 23 of suitable rigid material having an outside diameter considerably less than the inside diameter of the auger shaft is progressively installed centrally down the auger shaft, 11*a*, in the manner of the aforesaid installation of the segmented auger 11, to have the lower end of the pipe 23 supported by the bit 19 without releasing the bit from the auger shaft, and so that the lower end of the pipe 23 is fluid-sealed by engagement thereof with a flat surface 24, defined by a frusto-conical recess 25 provided for centering the pipe in the auger shaft. Thus, the O.D. of the pipe 23 and I.D. of the auger shaft 11*a* define therebetween an axially extending, tubular space into which fluid self-hardenable cement mortar is now fed from the conduit 16, and allowed to set and harden as a tubular concrete filler body 26 as shown in FIG. 7, whereby the pipe 23 becomes an integral, permanent part of the retained auger 11 in the cavity 15*f*.

Figure 8:
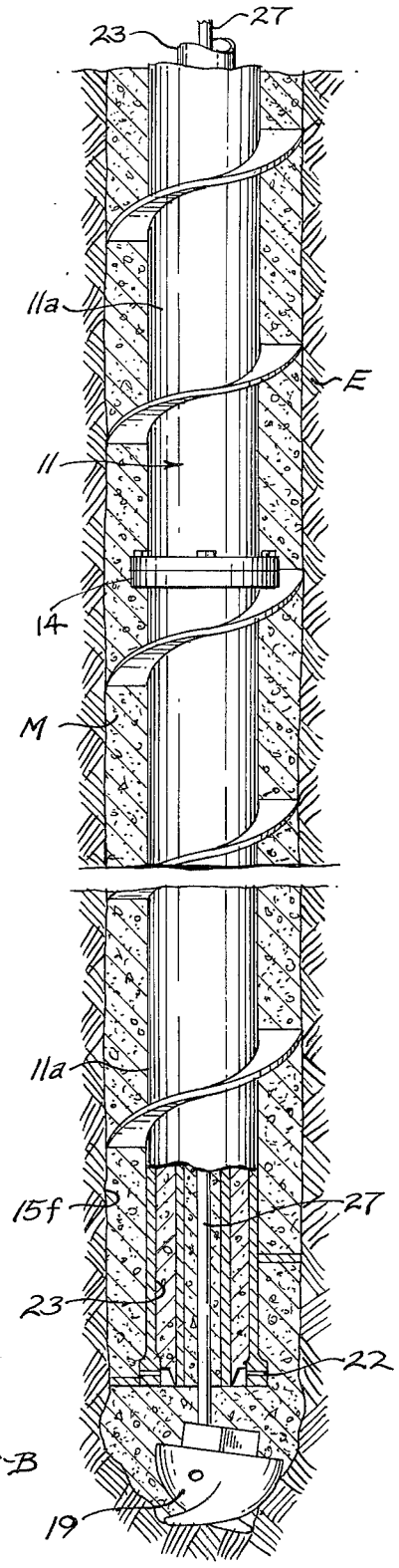
FIG. 8 is a view corresponding to FIG. 7, wherein the mortar in said annular space has hardened, with pipe anchored in the auger shaft, and wherein the bit has been knocked out for pumping pressurized cement mortar down the pipe for filling the cavity as before, as well as the pipe, with a bit releasing element retained as a tension rod or reinforcement.

Upon such hardening of the filler of mortar 26 suitable means, such as a segmentally assembled steel rod 27, may be placed down the I.D. of the anchored pipe 23, as by way of a suitable flapper valve means 12*b* in the fixed housing 12*a* on drill carriage 10, or by uncoupling the auger from the carriage 12 and inserting the rod 27 into the upper end of the pipe and forcibly urging the rod 27 downwardly to release the bit from the end of the auger shaft into the space below the same as shown in FIG. 8. Still referring to FIG. 7, however, with the bit so released and with said flapper open as shown in FIG. 1, fluid cement mortar, under pressure, is fed down the anchored pipe 23 for discharge from the bottom of the pipe into the bottom of the augered cavity while the auger is rotated in a screwing direction forcibly to convey the fluid mortar 26 upwardly along the auger flighting, thereby to fill the cavity 15*f* and form a columnar concrete body with the auger embedded therein and including hardened mortar contained in the pipe (See FIG. 8). The knock-out rod 27 may be retained in the composite, metal reinforced concrete column, either as additional reinforcement therein, or as a tension member or tie-rod of known type.

The method procedure, described in connection with FIGS. 7 and 8, has a particularly important value in that fluid mortar fed through the pipe 23 can be supplied under sufficiently high pressure to be pumped into the bottom of the cavity 15*f*, as described above, to travel upwardly along the auger flighting, and more importantly to travel to an increased extent up and around the outer edges of the auger flighting while the auger is rotating, thereby to accomplish an ultimate increase in the skin friction between the hardened concrete body and the drilled cavity wall. In addition, by pumping highly pressurized fluid cement mortar through the pipe 23 and into the cavity at 21, against the solid backing of the end of the auger shaft, it is possible to practice the method under a predetermined formula, based on the pressure of the fluid mortar as required to fill the pipe 23 and to solidify along the auger flighting and around the edges thereof, as described above, and relating the formula back to the load-carrying capacity of the pile. This procedure can, of course, be followed with or without formation of a bulb B as described above in reference to FIG. 7.

While the present invention has primary application in situations where low headroom conditions exist, necessitating the use of one or more short sections of continuous flight auger to drill a hole of predetermined depth, it will be apparent that substantially the same procedure may be followed for installation of augered tie backs as well as vertical or batter piles utilizing a single section of continuous flight auger of the desired length or a plurality of auger sections which have been preassembled to provide a continuous flight auger of the desired full length prior to drilling.

Figure 9:
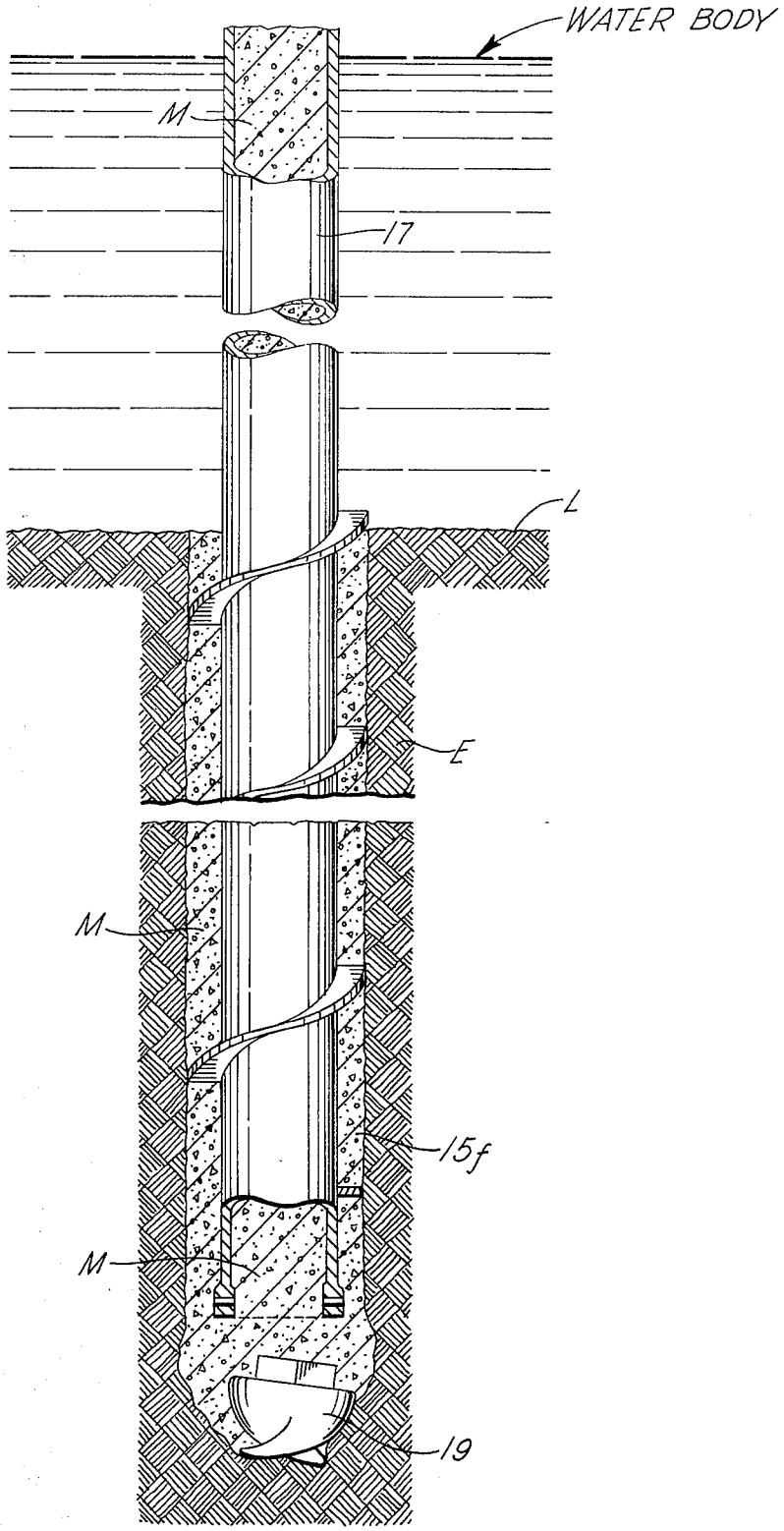
FIG. 9 is an enlarged fragmentary cross-section showing a modified form of concrete-auger pile body constructed in accordance with this invention.

It will also be appreciated that the entire length of auger consisting of one or more auger sections need not be embedded completely in the ground. For example, when installing concrete piles or like concrete columns below water, only a portion of the auger need be embedded in the earth below the mud line with the remainder of the auger projecting through the water. Of course, in that event, only that portion of the auger which is below the mud line will be encased in concrete, while the center shaft of the auger may be filled with concrete to the full extent. Also, the auger flighting may be omitted from the upper portion of the hollow shaft 17 extending above the mud line L as shown, for example, in FIG. 9. The length of hollow shaft extending above the earth situs will vary as required, and is shown in FIG. 9 extending above the body of water beneath which the concrete pile has been installed. The orientation of the concrete pile or like concrete column may be vertical as shown or at any desired angle, depending on the particular use, for example, a tension or compression pile, a tie back, or a batter pile. Since the method of installation of the concrete pile or like column shown in FIG. 9 may otherwise be substantially the same as the concrete piles or like columns previously described, no further discussion is thought to be necessary.

Whereas the preferred forms of the invention have been shown and described herein, it should be realized that there may be many modifications, substitutions and alterations thereto.

Other modifications of the invention may be resorted to without departing from the spirit thereof or the scope of the appended claims. As an example, the method of the invention can be utilized in placing diagonal tension piles as well as vertical concrete columns.

The embodiments of the invention in which an exclusive property or privilege is claimed are defined as follows:

1. A method as for forming a concrete pile or like column in an earth situs, comprising the steps of: drilling a first one of a plurality of relatively short sections of a continuous flight auger in screwing direction into the situs, to form a cavity of correspondingly short axial extent; progressively fixedly attaching additional such auger sections to the upper end of the auger to extend the length thereof, and likewise progressively repeating the drilling operation, thereby to extend the cavity depth by increments to requisite full depth thereof; rotating the extended auger in screwing direction within the full-depth cavity to remove the augered earth outwardly therefrom, while retaining the extended auger within the full depth cavity; feeding self-hardenable fluid cementitious material into the cavity to fill the same; and allowing such fluid cementitious material within the cavity to harden as a columnar body with such auger embedded therein.

2. A method as in claim 1, wherein said feeding of cementitious material includes rotation of the retained auger in screwing direction to convey such fluid cementitious material from the bottom of the cavity upwardly in the flighting of the auger, to fill the cavity space surrounding the auger vacated by removal of the angered earth from the flighting.

3. A method as in claim 2, wherein the step of feeding fluid cementitious material to fill the cavity includes passage of the material through a hollow shaft of the auger, and the cementitious material is allowed to fill the hollow of the shaft and become a part of the columnar body in which the auger is embedded.

4. A method as in claim 3, including a step of providing reinforcing means within such hollow shaft to be embedded within the cementitious material therein.

5. A method as in claim 4, wherein the step of feeding fluid cementitious material to fill the cavity includes passage of the material thrugh a hollow shaft of the auger, and the cementitious material is allowed to fill the hollow of the shaft and become a part of the columnar body in which the auger is embedded, such reinforcing means including a series of sections of rod progressively attached one to another in timed relation to the fixed attachment of such short sections of the auger.

6. A method as in claim 1, wherein subsequent to such removal of the augered earth from the cavity, and prior to feeding the cementitious material into the same, the steps of the method include: positioning a conduit centrally in a hollow shaft of the auger; filling a space between the conduit and such shaft with self-hardenable cementitious material and allowing the same to harden with the conduit retained in place; and thereafter pumping the self-hardenable fluid, cementitious material, while under pressure, through such conduit into the bottom of the cavity, against the backing of the inner end of the auger of the aforesaid step of feeding the fluid material to fill the cavity for such hardening as a columnar body.

7. A method as for forming a concrete pile or like column in an earth situs, comprising the steps of: drilling a continuous flight, hollow-shafted auger in screwing direction into the situs, to produce a body forming cavity of required full depth; rotating the extended auger in screwing direction within the full-depth cavity to remove the augered earth outwardly therefrom, while retaining the extended auger within the full depth cavity; providing a filler of hardened cementitious material in such auger shaft to adjacent the inner end of the same, to have a passage through the same for connection with the inner end of such cavity; feeding fluid self-hardenable cementitious material, under pressure, through such passage, first to build up pressure in the inner end of the cavity against the backing of the inner end of the auger, and then to fill the cavity along the flighting of the rotating auger with application of radial pressure of the fluid material along the body-forming cavity wall, tending to enlarge the same and thereby to increase the skin friction between the ultimately hardened concrete body and the body forming cavity wall; and maintaining the auger stationary while allowing such fluid cementitious material within the cavity to harden as a columnar body, with such auger embedded therein.

8. A method as in claim 7, wherein such feeding of cementitious material under pressure includes rotation of the retained auger in screwing direction to facilitate controlled movement of such fluid cementitious material upwardly in the flighting of the auger.

9. A method as in claim 8, wherein the step of feeding fluid cementitious material to fill the cavity includes passage of the material through a hollow conduit positioned within such filler of hardened cementitious material to serve as a reinforcing part of the columnar body in which the auger is embedded.

10. A method as in claim 9, wherein cementitious material retained in such passage in such hardened filler is allowed to harden therein as a solid part of the columnar body.

11. A method as in claim 10, wherein a reinforcing member is placed to become anchored in such hardened cementitious material in such passage.

12. A method as in claim 7, wherein, prior to feeding the cementitious material through such passage to fill such cavity, an elongated rigid element is positioned above a closure member removably closing the inner end of such passage, and wherein such element is forcibly operated to remove such closure member and permit such feeding of the body-forming, fluid material into such body-forming cavity.

13. A method as in claim 7, wherein, prior to feeding the cementitious material through such passage to fill such cavity, and elongated rigid element is positioned above a closure member removably closing the inner end of such passage, and wherein such element is forcibly operated to remove such closure member and permit such feeding of the body-forming, fluid material into such body-forming cavity; such rigid element being retained positioned in such passage to be anchored therein by hardening of fluid material retained in the passage.

14. A method as for forming a concrete pile or like column in an earth situs, comprising the steps of: drilling a continuous flight auger in screwing direction into the situs to form a cavity of requisite depth; rotating the auger in a screwing direction within the cavity to remove the augered earth outwardly therefrom, while retaining the auger against axial movement within the cavity, and replacing the cavity space vacated by the upward removal of augered earth from at least the lowermost auger flighting with a self-hardenable fluid cementitious material; and allowing such fluid cementitious material to harden as a columnar body with such auger embedded therein.

15. A method as in claim 14, wherein such cementitious material is fed through a hollow shaft of the auger into the bottom of the cavity and is conveyed upwardly in the flighting of the auger to fill the cavity space surrounding the auger vacated by removal of the augered earth from such flighting.

16. A method as in claim 15, wherein at least the lower portion of the hollow shaft of the auger is filled with such cementitious material which is allowed to harden and become a part of the columnar body in which the auger is embedded.

17. A method as in claim 14, wherein a portion of the auger protrudes above the earth situs after drilling a cavity of the requisite depth, and such auger includes a hollow shaft which is filled with such cementitious material extending above the earth situs and allowed to harden as a columnar body within such auger.

18. A method as in claim 14, wherein such auger consists of a plurality of relatively short auger sections which are connected together in succession during drilling to form the cavity by increments to the requisite full depth thereof.

19. A method as in claim 14, wherein such auger includes a hollow shaft portion without flighting thereon extending from the upper end of the auger above the earth situs, such hollow shaft portion being at least partially filled with such cementitious material which has been allowed to harden as a columnar body within such hollow shaft portion.

20. A method as in claim 19, wherein such hollow shaft portion extends through a water body, and such auger is embedded in the earth situs below the mud line of such water body.

21. A concrete pile or like column in an earth situs comprising a continuous flight hollow shaft auger having at least a portion thereof embedded in an earth situs, the lower flighting of such auger being free of augered earth and surrounded by hardened cementitious material, and the lower portion of said hollow shaft of said auger also being filled with hardened cementitious material to provide a columnar body with at least the lower portion of said auger embedded therein.

22. A concrete pile or like column as in claim 21 wherein a portion of said auger protrudes above the earth situs, and the hollow shaft of said auger is filled with such hardened cementitious material to a level above the earth situs.

23. A concrete pile or like column as in claim 21 wherein said auger includes a hollow shaft portion without flighting extending from the upper end of said auger above the earth situs, said hollow shaft portion being at least partially filled with hardened cementitious material to a level above the earth situs, said hollow shaft portion extending through a water body, and said auger being embedded below the mud line of such water body.

24. A concrete pile or like column as in claim 22 wherein a portion of said auger protruding above the earth situs is without flighting thereon.

25. A concrete pile or like column as in claim 21 wherein rigid reinforcing means is embedded within the hardened cementitious material in said hollow shaft.

26. A concrete pile or like column as in claim 21 further comprising a conduit disposed centrally within said hollow shaft of said auger, the space between said conduit and shaft being filled with hardened cementitious material with said conduit retained in place.

27. A concrete pile or like column as in claim 26 wherein said conduit is at least partially filled with hardened cementitious material, and reinforcing means is embedded within such hardened cementitious material within said conduit.

* * * * *